US010894217B2

(12) United States Patent
Scortia

(10) Patent No.: US 10,894,217 B2
(45) Date of Patent: Jan. 19, 2021

(54) NOVELTY FLATULENCE DEVICE

(71) Applicant: Scot Whitcomb Scortia, Pensacola, FL (US)

(72) Inventor: Scot Whitcomb Scortia, Pensacola, FL (US)

( * ) Notice: Subject to any disclaimer, the term of this patent is extended or adjusted under 35 U.S.C. 154(b) by 0 days.

(21) Appl. No.: 16/658,997

(22) Filed: Oct. 21, 2019

(65) Prior Publication Data

US 2020/0122047 A1 Apr. 23, 2020

Related U.S. Application Data

(60) Provisional application No. 62/747,887, filed on Oct. 19, 2018.

(51) Int. Cl.

| | |
|---|---|
| ***A63H 1/32*** | (2006.01) |
| ***A63H 5/00*** | (2006.01) |
| ***A63H 37/00*** | (2006.01) |

(52) U.S. Cl.

CPC ..... *A63H 5/00* (2013.01); *A63H 37/00* (2013.01)

(58) Field of Classification Search

USPC ..... 446/26, 27, 71, 236, 253, 397

See application file for complete search history.

(56) References Cited

U.S. PATENT DOCUMENTS

| | | | | | |
|---|---|---|---|---|---|
| 2,988,846 | A * | 6/1961 | Samuel | A63H 1/32 | 446/253 |
| 3,234,684 | A * | 2/1966 | Bridges | A63H 1/32 | 446/254 |
| 3,410,022 | A * | 11/1968 | Behl | A63H 1/00 | 446/260 |
| 3,665,641 | A * | 5/1972 | Henderson | A63H 27/12 | 446/45 |
| 3,672,094 | A * | 6/1972 | Vigorito | A63H 1/32 | 446/253 |
| 3,721,037 | A * | 3/1973 | Allen | A63H 1/32 | 446/244 |
| 4,872,671 | A * | 10/1989 | Brandell | A63B 21/00043 | 482/126 |
| 5,254,028 | A * | 10/1993 | Liao | A63H 3/24 | 446/297 |
| 8,597,068 | B1 * | 12/2013 | Stathis | A44C 15/005 | 446/253 |

* cited by examiner

*Primary Examiner* — Nini F Legesse

(74) *Attorney, Agent, or Firm* — Dunlap Bennett & Ludwig, PLLC; Brendan E. Squire

(57) ABSTRACT

A novelty flatulence device is small, uses mechanical energy, stays in wound up, armed condition while it is being hidden for activation. The novelty flatulence device produces a realistic flatulence sound for entertainment and sound effects purposes. The novelty flatulence device includes a carrier base with opposed support arms. Elastic bands are attached to the support arms and a spinner is rotatably carried on the elastic bands.

11 Claims, 4 Drawing Sheets

NOVELTY FLATULENCE DEVICE

CROSS-REFERENCE TO RELATED APPLICATION

This application claims the benefit of priority of U.S. provisional application No. 62/747,887, filed Oct. 19, 2018, the contents of which are herein incorporated by reference.

BACKGROUND OF THE INVENTION

The present invention relates to novelty items, and more particularly to novelty items simulating flatulence sounds.

Throughout the years, flatulence devices have employed as a practical joke that attempt to simulate a loud and realistic flatulence noise from one's back-side While there have been many such flatulence devices, these other devices require batteries, remote controls, or, in the case of the bladder, air impregnated into it. These devices are obvious, can be unrealistic, and may require logistical planning to set up.

Others employed an elastic band, but lacked sufficient energy or were susceptible to slinging a noise making disk when the elastic band would break.

As can be seen, there is a need for an improved device for simulating flatulence sounds that is simple, small, uses mechanical energy, stays wound up while it is being hidden by one's behind, and allows for a realistic raising of the cheek to release the flatulence noise.

SUMMARY OF THE INVENTION

In one aspect of the present invention, a novelty flatulence device is disclosed. The novelty flatulence device includes a carrier base having a pair of opposing arms with an attachment point on each of the opposing arms. A first elastic band and a second elastic band are attached to each attachment point. A spinner element is rotatably carried by the first elastic band and the second elastic band, such that the first elastic band and the second elastic band store potential energy when the spinner is wound and convert the potential energy to kinetic energy and impart it to the spinner when the spinner is released.

In some embodiments, a hole is defined through a face of the spinner element. Each of the first elastic band and the second elastic band are routed through the hole. A first end and a second end of the first elastic band may be attached to the attachment point. A first end and a second end of the second elastic band may be attached to the attachment point on the opposing arm.

In some embodiments, the carrier base is substantially U shaped. In other embodiments, the carrier base is substantially V shaped.

In some embodiments, the spinner is formed of a rigid material. In other embodiments, the spinner is formed of a semi-rigid material.

When the spinner is released a flatulence sound is emitted when the spinner impacts a supporting surface.

In other aspects of the invention a method of producing a novelty flatulence sound is disclosed. The method includes winding a spinner of a novelty flatulence device, where the spinner is rotatably carried between opposed support arms of a carrier base by a first elastic band and a second elastic band.

The wound novelty flatulence device is placed on a support surface.

The spinner may then be released, such that unwinding of the first elastic band and the second elastic band impart a rapid rotation of the spinner contact of the spinner with the support surface emits the novelty flatulence sound.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved novelty flatulence device that is simple in construction, easy to ready and emplace, and leads to hours of fun as a novelty item for practical jokes. The novelty flatulence device produces a loud and realistic flatulence noise from one's back-side.

Figure 1:
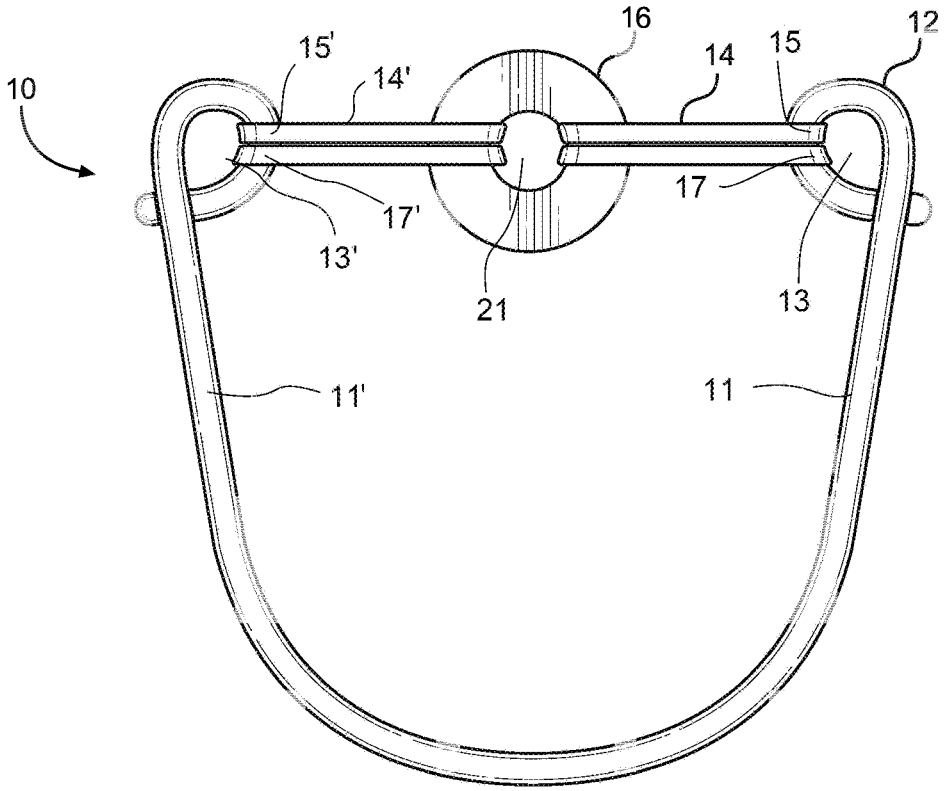
FIG. 1 is a front view of the flatulence device.
Figure 2:
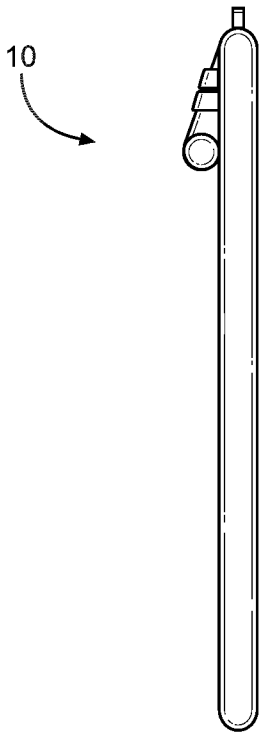
FIG. 2 is a side view of the flatulence device.
Figure 3:
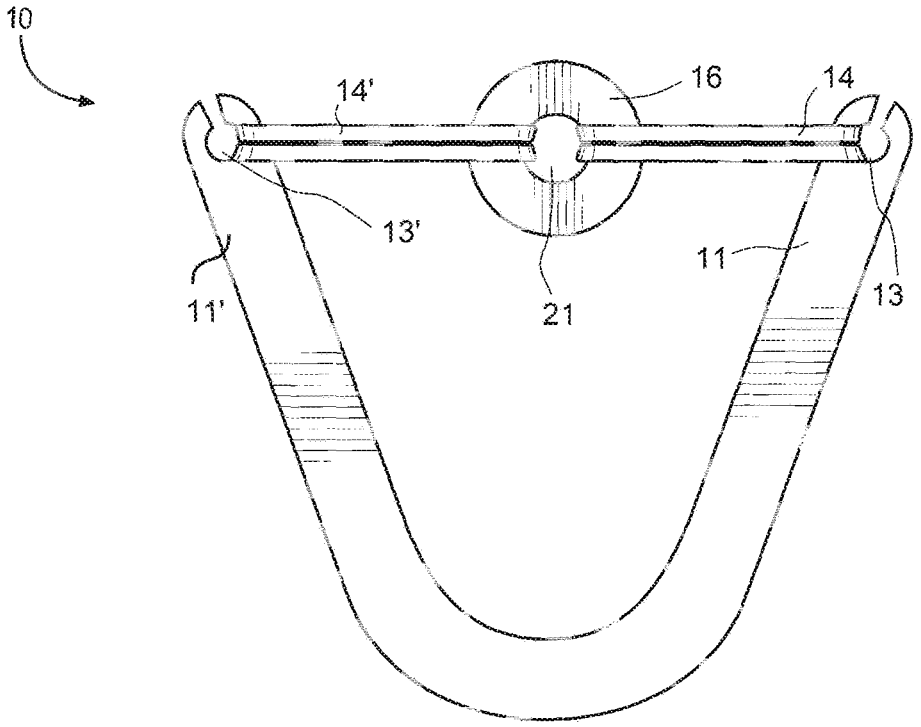
FIG. 3 is a front view of an alternate embodiment of the flatulence device.
Figure 4:
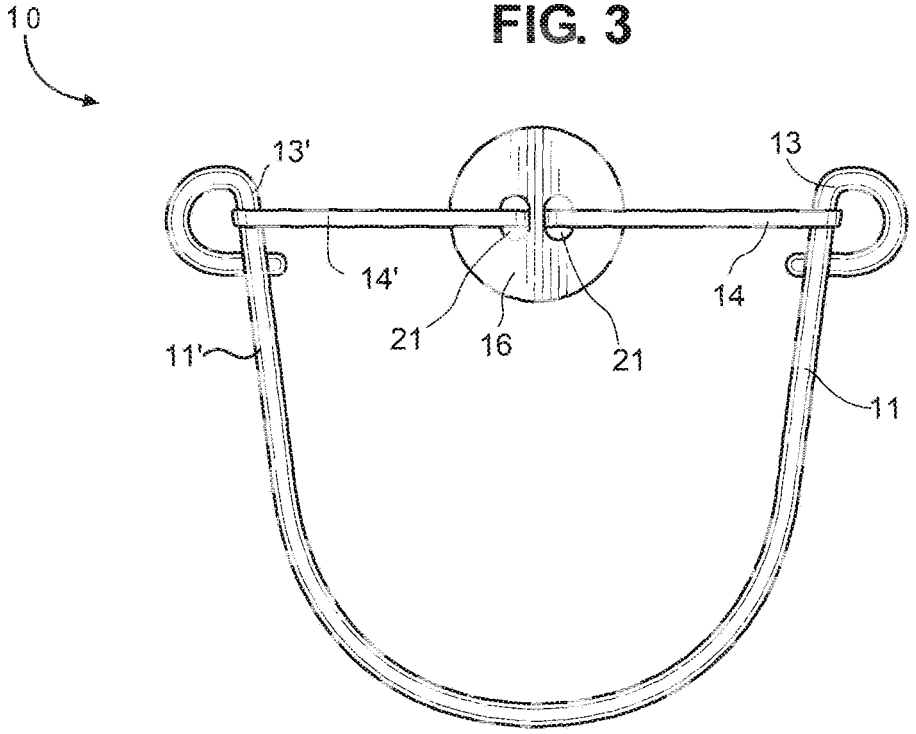
Prior Art FIG. 4
FIG. 4 is a front view of a prior art embodiment of the flatulence device.
Figure 5A:
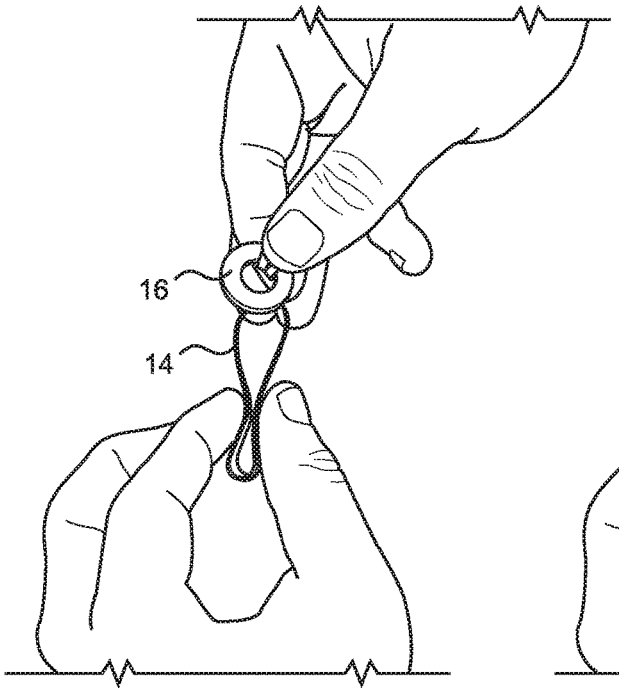
FIG. 5*a* is view of the band being inserted into the spinner by the user.
Figure 5B:
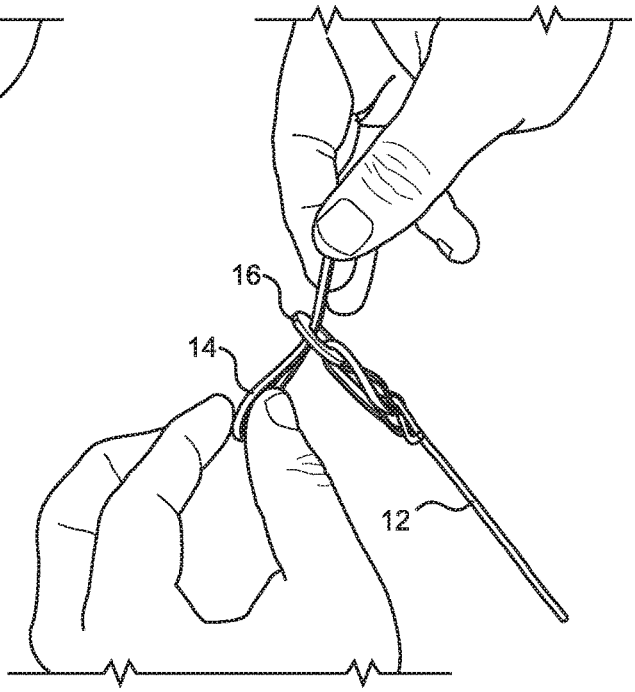
FIG. 5*b* is a view of the other band being inserted into the spinner.
Figure 5C:
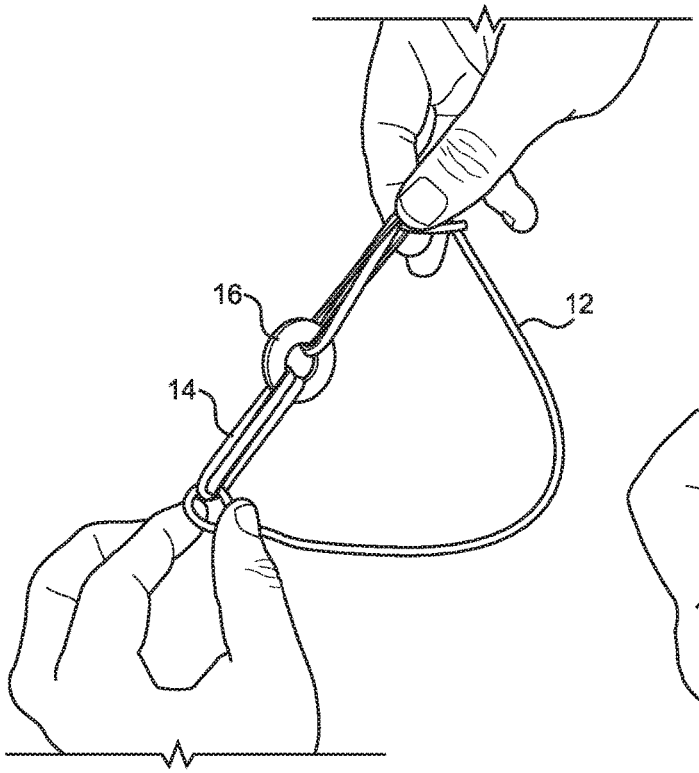
FIG. 5*c* is a view of the base being inserted into the ends of the bands.
Figure 6:
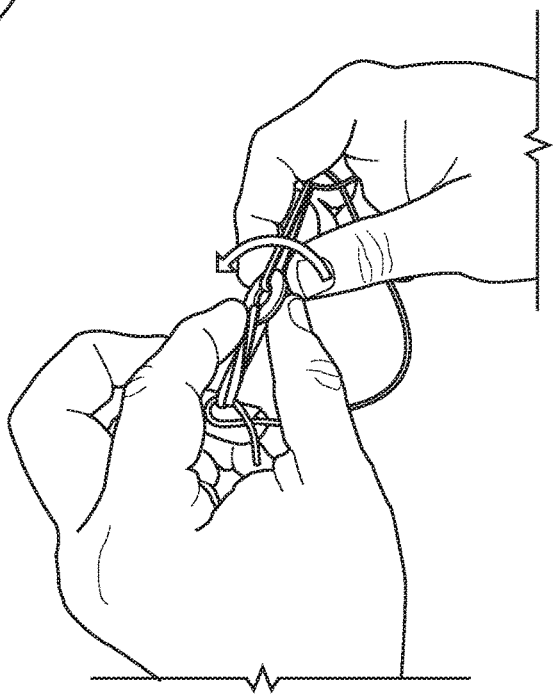
FIG. 6 is a view of the spinner being wound by the user.
Figure 7A:
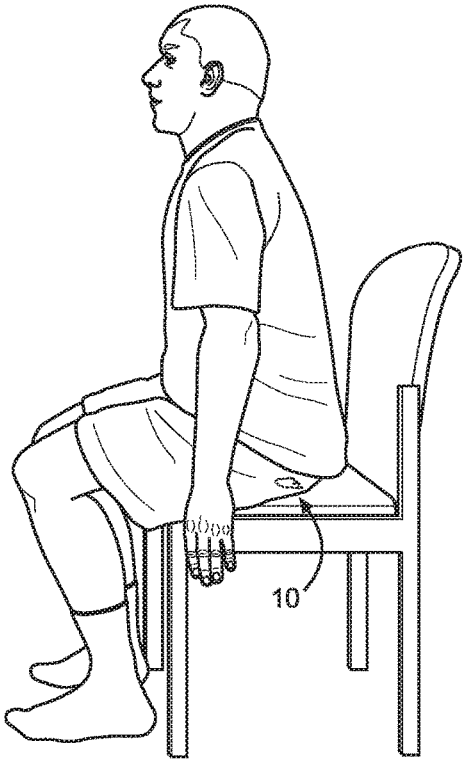
FIG. 7*a* is a view of the flatulence device being used.
Figure 7B:
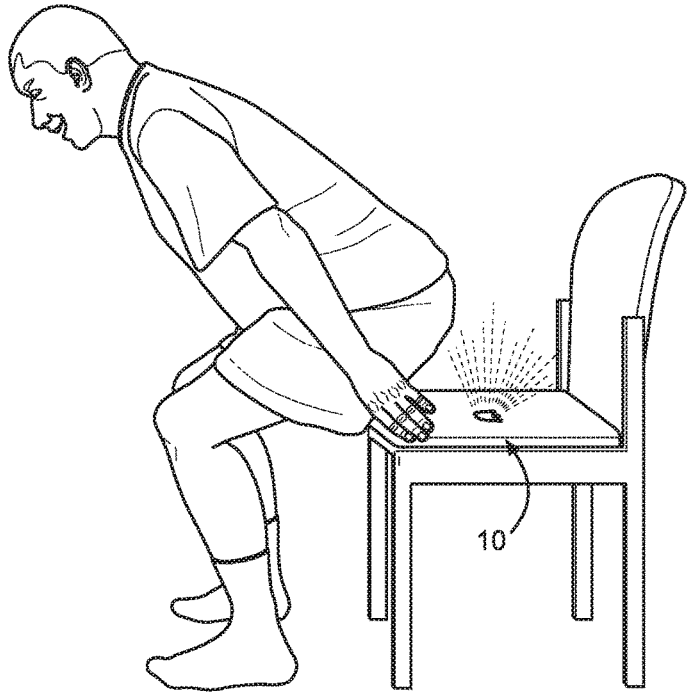
FIG. 7*b* is a view of the flatulence device being used.
Figure 8:
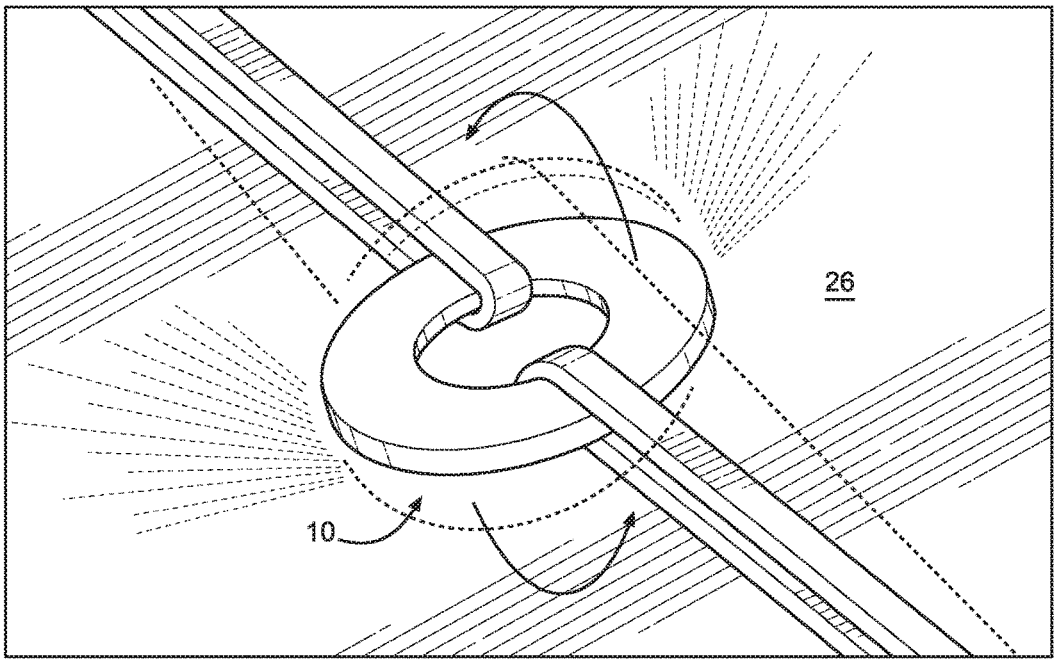
FIG. 8 is a close-up view of the flatulence device as it is engaged.

A non-limiting embodiment of a novelty flatulence device of the present invention is shown in reference to the drawings of FIGS. 1-3. The novelty flatulence device 10 utilizes elastic bands 14 and a rigid or semi rigid spinner 16 formed of a plastic, wood, rubber, or metallic material connected to the elastic bands 14. The first elastic band 14 and second elastic bands 14' are attached to opposed arms 11, 11' of a V or U shaped carrier base 12.

The spinner 16 is operatively coupled to the carrier base 12 by the elastic bands 14. The spinner 16 is wound up and the device placed on a surface 26, such as a cushion or chair seat beneath a user's backside when sitting upon the chair. When user lifts up, the spinner 16 discharges in a flapping motion against the surface 26 thereby emitting a loud flatulence sound.

As previously indicated, the novelty flatulence device 10 is small and compact and does not use air. Unlike bladder type flatulence devices, which requires one to sit upon it to make the noise, the device of the present invention will make the noise when the perpetrator raises one side of his/her behind. The result is a very realistic sound of flatulence. Other devices don't allow the user to go through the realistic motion of "lifting a cheek" and releasing the flatulence sound. The device is simple, small, uses mechanical energy, stays wound up while it is being discretely hidden beneath the user's behind, and allows for a realistic raising of the cheek to release the noise.

The V or U shaped carrier base 12, may be formed of a metallic, hard plastic, wood, or similar formed in the V or U shaped carrier base 12, having a left arm 11 and a right arm 11'. The spinner 16 is attached to the arms 11, 11' of carrier base 12 with a plurality of heavy-duty rubber/elastic bands 14, 14'. The arms 11, 11' have a width that is less than a width of the spinner 16 such that ends of the spinner 16 may impact a support surface 26 when the spinner 16 unwinds.

In the embodiments shown, in FIGS. 1-3, the carrier base 12 provides an attachment point 13 disposed at the ends of the arms 11, 11' for receiving two elastic bands 14, 14' as well as serving as a means of stabilizing the device for winding and positioning. The elastic bands 14, 14', when wound, provide the potential energy storage that is eventually converted to kinetic energy when the spinner 16 is released. The spinner 16 may be formed as a round, flat, disc. In a non-limiting example, the diameter is approximately ⅞". A hole 21 is provided in the center of the spinner 16.

The elastic bands 14, 14' are routed through the hole 21 in the spinner 16 and attached to each loop, or attachment point 13, 13' of the base 12. The device 10 can be wound up and held in place by sitting upon it until time for release. A person who wishes to feign flatulence will sit on the device 10 once wound up with the spinner 16 held under tension by the elastic bands 14, 14' and, at the right moment, raise up just enough to cause the spinner 16 to spin while the device 10 remains held in place with the carrier base 12. The result can range from a very realistic sound to obviously fake noises depending on the material composition of the spinner 16 and that of the seat 26. For example, with a padded cushion, a solid spinner 16 element is preferred for providing a more realistic sound. For a solid seat bottom, a semi-rigid material, such as rubber may provide a more realistic flatulence sound.

The dual elastic band 14 structure and individual routing through the spinner 16 impart additional energy to the spinner and facilitate retention of the spinner 16 with the flatulence device 10 should one of the two elastic bands 14 break. This is particularly effective if one of the elastic bands 14 breaks when the flatulence device 10 is in a wound condition. Where previous devices would have a tendency to launch the spinner 16 as the bands unwound, the second elastic band 14 of the present invention will allow the spinner 16 to be retained with the device 10.

Construction of the carrier base 12 may be as simple as using a thick, firm metal wire (comparable to the consistency and strength of a metal coat hangar). The carrier base 12 should be bent to form a "U" shape. Two loops must be added at each end to hold the rubber bands 14. The base 12 can also be formed out of a rigid plastic using an injection molding techniques or 3D printing techniques.

A first end 15, 15' of each elastic band 14, 14' is routed through the hole 21 of the spinner 16, leaving the elastic bands 14, 14' in-tact for durability, resiliency, and to facilitate attachment of the spinner 16 to the arms 11, 11' of the carrier base 12. The first end 15, 15' of the elastic band 14, 14' is stretched over and attached to attachment point 13, 13'. A second end 17, 17' of the elastic band 14, 14' will then be attached to the same attachment point 13, 13' in the same manor.

The present invention is a novelty item and is not intended to solve any problem other than provide a funny and realistic bodily function noise using a simple mechanical means in a compact and easily concealable manner.

It should be understood, of course, that the foregoing relates to exemplary embodiments of the invention and that modifications may be made without departing from the spirit and scope of the invention as set forth in the following claims.

What is claimed is:

1. A novelty flatulence device, comprising:

a carrier base having a pair of opposing arms with an attachment point on each of the opposing arms;

a first elastic band and a second elastic band attached to each attachment point; and a spinner element rotatably carried by the first elastic band and the second elastic band, a hole defined through a face of the spinner element, each of the first elastic band and the second elastic band are routed through the hole such that the first elastic band and the second elastic band are under a tension when the spinner element is wound and impart the tension to the spinner element when the spinner element is released.

2. The novelty flatulence device of claim 1, wherein a first end and a second end of the first elastic band is attached to the attachment point.

3. The novelty flatulence device of claim 2, wherein a first end and a second end of the second elastic band is attached to the attachment point on the opposing arm.

4. The novelty flatulence device of claim 3, wherein the carrier base is substantially U shaped.

5. The novelty flatulence device of claim 3, wherein the carrier base is substantially Y shaped.

6. The novelty flatulence device of claim 1, wherein the spinner element is formed of a rigid material.

7. The novelty flatulence device of claim 1, wherein the spinner element is formed of a semi-rigid material.

8. The novelty flatulence device of claim 1, wherein when the spinner element is released a flatulence sound is emitted when the spinner impacts a supporting surface.

9. A method of producing a novelty flatulence sound, comprising:

winding a spinner of a novelty flatulence device, where the spinner is rotatably carried between opposed support arms of a carrier base by a first elastic band and a second elastic band, a hole defined through a face of the spinner element, each of the first elastic band and the second elastic band are routed through the hole such that the first elastic band and the second elastic band are under a tension when the spinner element is wound and impart the tension to the spinner element when the spinner element is released.

10. The method of claim 9, further comprising:

placing the novelty flatulence device on a support surface.

11. The method of claim 10, further comprising:

releasing the spinner, such that unwinding of the first elastic band and the second elastic band impart a rapid rotation of the spinner, such that contact of the spinner with the support surface emits the novelty flatulence sound.

* * * * *